United States Patent [19]

Luken, Jr. et al.

[11] Patent Number: 4,682,947

[45] Date of Patent: Jul. 28, 1987

[54] DECORATIVE CANDLES

[75] Inventors: Clement H. Luken, Jr., Highland Heights; Donald V. Kinsman, Fort Thomas, both of Ky.

[73] Assignee: National Distillers and Chemical Corporation, New York, N.Y.

[21] Appl. No.: 893,423

[22] Filed: Aug. 5, 1986

Related U.S. Application Data

[63] Continuation-in-part of Ser. No. 776,711, Sep. 16, 1985, abandoned.

[51] Int. Cl.[4] ..... F23D 3/16

[52] U.S. Cl. ..... 431/288; 106/268

[58] Field of Search ..... 431/288, 291; D26/6; 106/245, 268

[56] References Cited

U.S. PATENT DOCUMENTS

| | | | |
|---|---|---|---|
| 252,590 | 1/1882 | Loper | 431/288 |
| 1,484,964 | 2/1924 | Rhoads | 431/288 |
| 2,279,354 | 4/1942 | Walters | 431/325 |
| 2,638,411 | 5/1953 | Thompson et al. | 106/268 |
| 3,770,865 | 11/1973 | Ralles | 431/291 |

*Primary Examiner*—Carroll B. Dority, Jr.

*Attorney, Agent, or Firm*—Kenneth D. Tremain; Gerald A. Baracka

[57] ABSTRACT

Pillar candles which upon burning develop a decorative, aesthetically pleasing, free-standing shell having a filigree or lace-like pattern are provided. The candles consist of a fatty acid fuel composition, predominantly stearic acid and palmitic acid, and a 27–45 ply flat cotton wick. To obtain the desired decorative effect, the ratio of wick size to candle diameter is maintained at 12 to 19 plies per inch.

11 Claims, 1 Drawing Figure

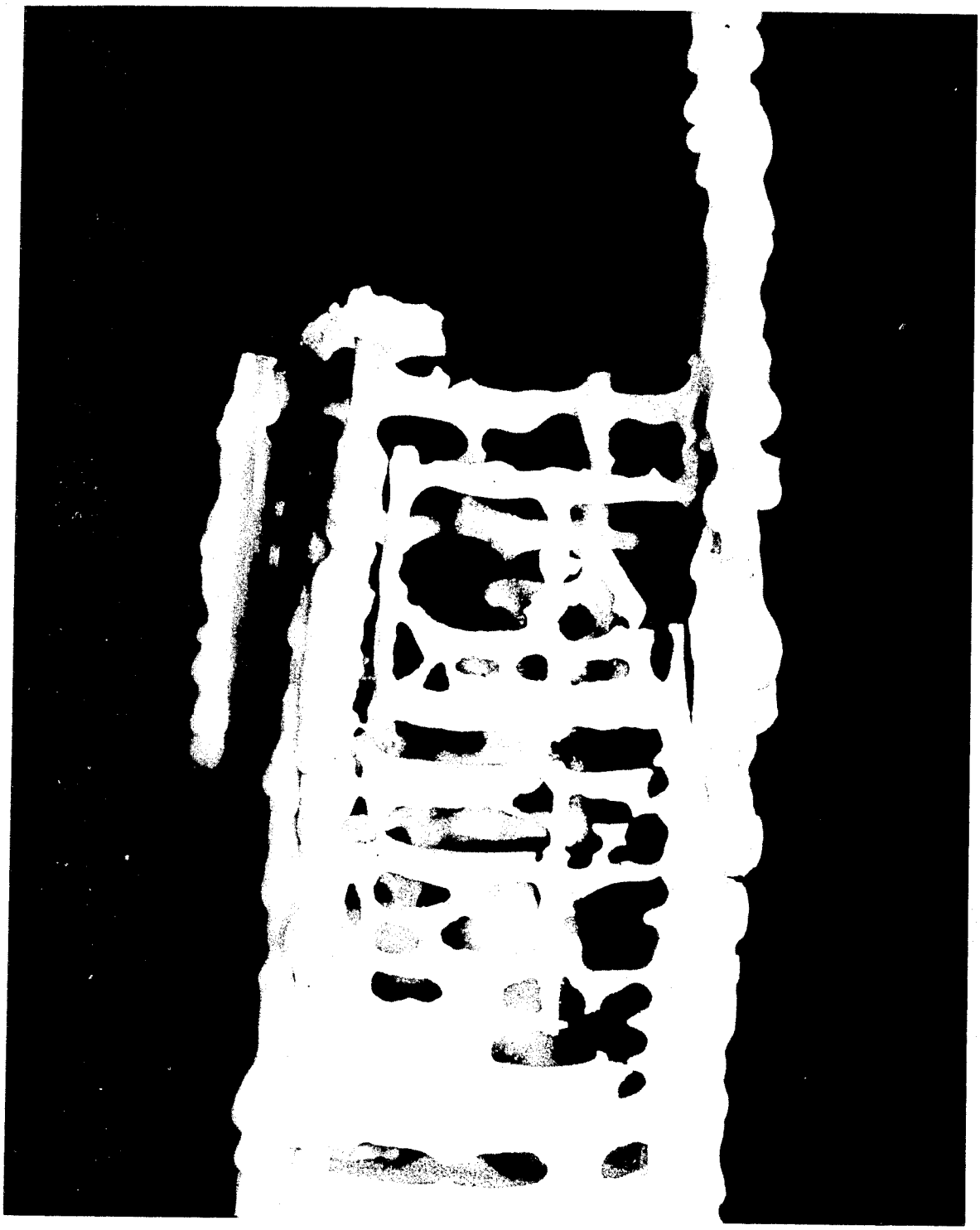

DECORATIVE CANDLES

CROSS-REFERENCE TO RELATED APPLICATIONS

This is a continuation-in-part of copending U.S. Pat. application serial No. 776,711, filed September 16, 1985 and now abandoned.

BACKGROUND OF THE INVENTION

1. Field of the Invention

This invention relates to pillar candles which upon burning create a decorative and aesthetically pleasing free-standing shell having a filigree or lace-like pattern.

2. Description of the Prior Art

The use of stearic acid and palmitic acid is known for the manufacture of candles. U.S. Pat. No. 21,706, for example, describes a process whereby candles constructed of low melting or greasy candle stock material are coated with stearic acid-containing compositions to obtain firm, smooth candles which do not gutter. For the process, compositions containing 50, 70, and 90 parts stearic acid are successively applied by dipping to coat the candle with three distinct layers of increasing hardness. This general procedure is still used today to produce the so-called nondrip candles.

A process for obtaining fatty acid compositions that can be used in the manufacture of candles is described in U.S. Pat. No. 741,584. For the process, a portion of a fatty acid, such as stearic acid, is reacted with an aromatic amine, such as aniline, to obtain mixtures containing a major amount of the fatty acid and a minor amount of the corresponding amide.

U.S. Pat. No. 2,638,411 discloses compositions containing palmitic-stearic acid mixtures with a microcrystalline wax and paraffin wax for the manufacture of candles which resist bending at high temperatures. Various stearic acid-containing candle compositions are also set forth and discussed in Volume 4, pages 58–63, of Kirk-Othmer Encyclopedia of Chemical Technology, 2nd edition.

Candles with a decorative exterior shell are also known. For example, burnable coated candles of wax or stearic acid having a metallic powdered coating and which burn substantially as effectively and as completely as ordinary wax or stearic acid composition candles are described in U.S. Pat. No. 1,967,879.

Candles having petal configurations arranged around a central core and which unfold and glow with a soft light as the candles are burned are the subject of U.S. Pat. No. 2,974,509. U.S. Pat. No. 4,225,552 describes decorative candles having a central core and an outer shell which melts at a somewhat higher temperature than the inner core and encases decorative wax elements. Upon burning, the decorative elements encased within the outer shell are illuminated and, as these elements melt, a surrealistic effect is obtained.

SUMMARY OF THE INVENTION

We have now quite unexpectedly discovered that by proper selection of the candle composition, candle diameter and wick size, it is possible to produce pillar candles which upon burning leave a free-standing decorative and aesthetically pleasing shell having a filigree or lace-like pattern. By careful control of the above-mentioned variables and the ratio of wick size to candle diameter, an unusual and dramatic decorative effect is obtained upon burning.

The pillar candles of this invention are comprised of a solid fuel cylinder having a diameter of from 2 to 3½inches with a 27 to 45 ply flat cotton wick centrally located within and extending axially from the base of the cylinder through the opposite end of the cylinder. Fuel compositions employed for preparation of the candles are fatty acid mixtures which titer between 50° C. and 66° C. and are comprised predominantly of stearic acid and palmitic acid. To obtain the desired decorative effect it is also necessary to maintain the ratio of wick size to candle diameter at 12 to 19 plies per inch.

BRIEF DESCRIPTION OF THE PHOTOGRAPH

FIG. 1 is a photograph showing the free-standing decorative shell obtained upon burning a pillar candle of this invention.

DETAILED DESCRIPTION OF THE INVENTION

Pillar candles, sometimes also referred to as column candles, are well known within the candlemaking industry. In general, these candles are extruded or molded and are cylindrical in shape. The diameter of the body of pillar candles is uniform over the entire length of the candle and is generally 1½inches or greater.

The pillar candles of this invention are conventional in form, however, upon burning they produce a decorative and aesthetically pleasing free-standing shell having a filigree or lace-like pattern. To obtain the decorative shell, reasonable care should be taken so that excessive drafts are not present when the candle is burned. Some guttering can occur as the candle is burned, however, this imparts longitudinal reinforcement to the delicate wax shell and does not detract from the overall effect.

To obtain the pillar candles of this invention which upon burning create a decorative and aesthetically pleasing free-standing shell having a filigree or lace-like pattern, it is necessary to employ a solid fuel composition which does not soften significantly before it melts. For this reason, fatty acid compositions wherein stearic acid and palmitic acid are the predominant fatty acid constituents are employed. The weight ratio of stearic to palmitic acid will vary, depending on the source, but generally ranges from 4:1 to about 1:4. Especially useful compositions for the preparation of the candles of this invention have weight ratios of stearic acid to palmitic acid of 2:1 to 1:2.

Since the fatty acids are typically derived from natural fats and oils, other fatty acids having from about 14 to 20 carbon atoms will be present with the stearic acid and palmitic acid. Such acids, however, are minor components of the fuel composition. It is also possible to include minor amounts of a microcrystalline wax in the fatty acid fuel composition. The fuel composition should titer from 50°C. to 66°C. Best results are obtained using fuel compositions which titer from 53°C. to 63°C.

When the fuel composition is comprised solely of fatty acids, i.e., no microcrystalline wax is employed, the stearic acid and palmitic acid constitute 85 percent or more of the fatty acid composition. The remaining 15 percent of the acids are other fatty acids having from about 14 to 20 carbon atoms. These acids include saturated and unsaturated acids such as margaric acid, pentadecanoic acid, myristic acid, oleic acid, linoleic acid, and palmitoleic acid. Most generally, the stearic acid and palmitic acid comprise 90 percent or more of the fatty acid composition.

When a microcrystalline wax is present, the candle composition will contain 75 percent or more stearic acid and palmitic acid, 15 percent or less other fatty acids having from 14 to 20 carbon atoms, and up to about 10 percent by weight of the microcrystalline wax. Whereas the microcrystalline wax can be present at levels down to as low as 0.1 percent, at least 0.5 percent microcrystalline wax is typically utilized. Most generally, when microcrystalline waxes are employed they are present in an amount from 1 to 5 weight percent. Microcrystalline waxes which can be used melt at sufficiently high temperatures so that the blend of wax and the fatty acid melts within the ranges specified above for the fuel compositions. Also, the microcrystalline wax should not soften appreciably before it becomes liquid, i.e., its melt characteristics should be similar to those of the stearic/palmitic acid. Minor amounts of other waxes, such as montan wax, carnauba wax, castor wax, Fischer-Tropsch waxes and aliphatic amide waxes, may also be present.

Small amounts of other additives such as mold release agents and agents which color or impart a pleasing scent to the candle can be added to and be present in the solid fuel cylinder which comprises the body of the candle. Typically such additives do not constitute more than 4 weight percent of the fuel composition and, more generally, they are present in an amount from 0.5 to 3 weight percent. To be useful, such additives must be compatible with the stearic acid and palmitic acid and should not significantly alter their melt characteristics. Conventional organic dyes are most generally used as colorants, however, inorganic pigments can be utilized at low levels to obtain light colors. Any of the known oil-based or oil-compatible fragrances can be used. Acceptable mold-release agents include mineral oils, silicone oils and other commercially available proprietary compositions.

Wick size, candle diameter, and the relationship (ratio) between the wick size and candle diameter must be maintained within specific limits if the desired free-standing lace-like shell is to be obtained. Candle diameters range from 2 to 3½ inches and, more preferably, from 2⅜ to 3¼ inches. If the diameter of the candle is too small and/or the size of the flame too large, the entire candle will be consumed. On the other hand, if the solid fuel cylinder, i.e., candle diameter, is too large and/or wick size too small, tunnelling will occur and the desired lace-like pattern will not develop.

Flat braided (plaited) cotton wicks available from commercial suppliers such as Atkins and Pearce are employed for the candle construction. The wicks will have from about 27 to about 45 plies (strands) plaited in the conventional manner from three groups of yarn containing from 9 to 15 plies each. The wicks have from about 8 to 13 picks per inch. The number of plies or strands is readily ascertained by counting the number of individual thread ends. The wicks may be treated in accordance with standard procedures known to the art to impart desirable burning characteristics.

The size of the wick, i.e., the number of plies, will vary depending on the size (diameter) of the candle. To achieve the desired decorative effect upon burning, the wick size to candle diameter must be maintained within the critical ratio of 12 to 19 plies per inch. Best results are obtained when this ratio is from 14 to 18 plies per inch of candle diameter.

The flat cotton wick is located centrally within the solid fuel cylinder—extending axially from the base of the fuel cylinder through the opposite end of the cylinder. In other words, the fuel cylinder is a solid body of wax having the wick embedded therein along its central axis.

To obtain the molded pillar candles which upon burning develop a filigree or lace-like pattern, as shown in FIG. 1, the fuel components of the candle composition are combined and heated to approximately 65°–70°C., or higher if necessary, to achieve melting. If a colorant or mold-release agent is to be used, it is generally added with the fuel components. After the candle components have been heated to the proper temperature and thoroughly mixed, the molten blend is poured into a clean dry mold inside which the proper sized flat cotton wick has been properly positioned. The contact surfaces of the mold should be made of material which does not readily react with molten fatty acids. If fragrance is to be used in the candle, it should be added to the molten blend just prior to pouring. The filled mold may be cooled with air or by water if jacketing is available. Slight heating of the mold may be required to facilitate removal of the hardened candle. If a mold-release agent is not included in the fuel composition, a suitable release agent may be applied to the interior surfaces of the mold.

The following examples illustrate the invention more fully but are not intended as a limitation on the scope thereof. All parts and percentages in the examples are on a weight basis unless otherwise indicated.

EXAMPLE I

A pillar candle was prepared utilizing a mixed fatty acid as the fuel source. The fatty acid mixture had a titer of about 58° C. and was comprised of 55 percent stearic acid, 41 percent palmitic acid, 3 percent myristic acid, and 1 percent margaric acid. The fatty acid composition was heated to about 70°C. and, when molten, poured into a two-inch diameter tin-plated mold having a 36 ply flat cotton wick positioned therein. The 36 ply flat wick was plaited using 3 yarns having 12 ends each 18/1 cotton thread. The resulting wick had an average thickness of 0.047", an average width of 0.098", and 10½±½ picks per inch. After cooling at ambient conditions, the candle was removed from the mold. The resulting solid pillar had a homogeneous, fine-grained, smooth, lustrous finish and burned with a steady, clean, yellow-white flame. As the burning progressed, a free-standing shell having a filigree or lace-like pattern as shown in FIG. 1 was obtained. By the addition of a small amount of limonene or the essential oil abies balsamea, scented pillars having comparable characteristics were obtained. Similarly, colored pillar candles which produced lattice-work walls were obtained by incorporating small amounts of Calco® Oil Red or Sudan® Yellow GRN in the fatty acid fuel composition.

EXAMPLE II

In a manner similar to that described in Example I, a two-inch pillar candle which formed lattice-work walls upon burning was prepared using a 27 ply flat cotton wick and a commercial stearic acid (Emery® Stearic Acid containing 96 percent stearic/palmitic acids and having a titer specification of 55.8°–60.0° C.). The wick was plaited from 3 yarns having 9 ends each 18/1 cotton thread. The wick had $11 \pm \frac{1}{2}$ picks per inch, an average thickness of 0.042", and an average width of 0.079". A partially jacketed water-cooled mold was employed to cool the candle. The resulting solid pillar had a smooth surface with good sheen and an opalescent quality. The candle burned with a clean, non-smoking flame to provide an aesthetically pleasing, free-standing shell having a filigree or lace-like pattern. A comparably useful candle was obtained when several percent microcrystalline wax (Shellmax ® 400 - m.p. 177° F.) was included with the stearic acid.

EXAMPLES III–IX

A series of pillar candles was prepared using different fatty acid fuel compositions. Candle diameters and wick sizes were also varied. Details for the various candles were as follows:

| Example | Fatty Acid Composition (Titer) | | Candle Diameter | Wick Plies |
|---|---|---|---|---|
| III | 55% Stearic | (58° C.) | $2\frac{3}{8}$" | 36* |
| | 41% Palmitic | | | |
| | 4% Other | | | |
| IV | 45.5% Stearic | (55° C.) | $2\frac{3}{8}$" | 36* |
| | 50% Palmitic | | | |
| | 4.5% Other | | | |
| V | 55% Stearic | (58° C.) | 3" | 45** |
| | 41% Palmitic | | | |
| | 4% Other | | | |
| VI | 95% Stearic | (68° C.) | $2\frac{3}{8}$" | 36* |
| | 5% Palmitic | | | |
| VII | 39% Stearic | (54.3° C.) | $2\frac{3}{8}$" | 36* |
| | 50% Palmitic | | | |
| | 11% Other | | | |
| VIII | 65% Stearic | (60° C.) | $2\frac{3}{8}$" | 36* |
| | 29% Palmitic | | | |
| | 6% Other | | | |
| IX | 4% Stearic | (59.5° C.) | $2\frac{3}{8}$" | 36* |
| | 91% Palmitic | | | |
| | 5% Other | | | |

*36 ends plaited from 3 cotton yarns (12 ends each); $10\frac{1}{2} \pm \frac{1}{2}$ picks per inch; avg. width 0.098"; avg. thickness 0.047".
**45 ends plaited from 3 cotton yarns (15 ends each); $9\frac{1}{2} \pm \frac{1}{2}$ picks per inch; avg. width 0.118"; avg. thickness 0.058".

All of the above-prepared pillar candles had good surface qualities and exhibited excellent burning characteristics. They all produced aesthetically pleasing, free-standing shells having a filigree or lace-like pattern.

We claim:

1. A pillar candle which upon burning leaves a decorative and aesthetically pleasing free-standing shell having a filigree or lace-like pattern comprised of a flat cotton wick having from 27 to 45 plies and having a thickness in the range of 0.042–0.058 inches and width in the range of 0.079–0.118 inches and centrally located within a solid fuel cylinder and extending axially from the base and through the opposite end of said cylinder; said fuel cylinder having a diameter of 2 to $3\frac{1}{2}$ inches with the ratio of wick size to candle diameter ranging from 12 to 19 plies per inch and comprised of a fatty acid composition having a titer from 50° C. to 66° C. and wherein the predominant fatty acids are stearic acid and palmitic acid.

2. A pillar candle in accordance with claim 1 wherein the fatty acid composition contains 85% or more stearic acid and palmitic acid and 15% or less other fatty acids having from 14 to 20 carbon atoms.

3. A pillar candle in accordance with claim 2 wherein the weight ratio of stearic acid to palmitic acid is from 4:1 to 1:4.

4. A pillar candle in accordance with claim 3 wherein the candle diameter is from $2\frac{3}{8}$ to $3\frac{1}{4}$ inches and the ratio of wick size to candle diameter is from 14 to 18 plies per inch.

5. A pillar candle in accordance with claim 4 wherein the fatty acid composition has a titer from 53° C. to 63° C. and contains 90% or more stearic acid and palmitic acid.

6. A pillar candle in accordance with claim 5 wherein the weight ratio of stearic acid to palmitic acid is from 2:1 to 1:2.

7. A pillar candle in accordance with claim 1 wherein the fatty acid composition contains 75% or more stearic acid and palmitic acid, 15% or less other fatty acids having from 14 to 20 carbon atoms, and up to about 10% by weight microcrystalline wax.

8. A pillar candle in accordance with claim 7 wherein the weight ratio of stearic acid to palmitic acid is from 4:1 to 1:4.

9. A pillar candle in accordance with claim 8 wherein the candle diameter is from $2\frac{3}{8}$ to $3\frac{1}{4}$ inches and the ratio of wick size to candle diameter ranges from 14 to 18 plies per inch.

10. A pillar candle in accordance with claim 9 wherein the wax contains 85% or more stearic acid and palmitic acid and has a titer from 53° C. to 63° C.

11. A pillar candle in accordance with claim 10 wherein the weight ratio of stearic acid to palmitic acid is from 2:1 to 1:2 and the microcrystalline wax is present in an amount from 1 to 5%.

* * * * *